US009424779B2

(12) United States Patent
Lee et al.

(10) Patent No.: US 9,424,779 B2
(45) Date of Patent: Aug. 23, 2016

(54) ORGANIC LIGHT EMITTING DISPLAY DEVICE AND DRIVING METHOD THEREOF

(71) Applicants: Dong-Hwan Lee, Yongin (KR); Seung-Kyun Hong, Yongin (KR); So-Young Park, Yongin (KR); In-Soo Lee, Yongin (KR)

(72) Inventors: Dong-Hwan Lee, Yongin (KR); Seung-Kyun Hong, Yongin (KR); So-Young Park, Yongin (KR); In-Soo Lee, Yongin (KR)

(73) Assignee: SAMSUNG DISPLAY CO., LTD., Yongin, Gyunggi-do (KR)

( * ) Notice: Subject to any disclaimer, the term of this patent is extended or adjusted under 35 U.S.C. 154(b) by 497 days.

(21) Appl. No.: 13/908,333

(22) Filed: Jun. 3, 2013

(65) Prior Publication Data

US 2014/0098083 A1 Apr. 10, 2014

(30) Foreign Application Priority Data

Oct. 10, 2012 (KR) ..... 10-2012-0112135

(51) Int. Cl.
*G09G 3/32* (2016.01)

(52) U.S. Cl.
CPC ..... *G09G 3/3291* (2013.01); *G09G 3/3233* (2013.01); *G09G 2300/0819* (2013.01); *G09G 2300/0842* (2013.01); *G09G 2300/0861* (2013.01); *G09G 2310/0297* (2013.01)

(58) Field of Classification Search
CPC . G09G 3/3291; G09G 3/3266; G09G 3/3233; G09G 2310/0297
USPC ..... 345/82, 213
See application file for complete search history.

(56) References Cited

U.S. PATENT DOCUMENTS

2005/0280614 A1* 12/2005 Goh ..... G09G 3/3233 345/76
2006/0071884 A1* 4/2006 Kim ..... G09G 3/3233 345/76
2011/0108844 A1* 5/2011 Kwak ..... G09G 3/3233 257/71
2012/0105495 A1 5/2012 Choi

FOREIGN PATENT DOCUMENTS

KR 10 2006-0031547 A 4/2006
KR 10 2012-0044503 A 5/2012

* cited by examiner

*Primary Examiner* — Jonathan Blancha
(74) *Attorney, Agent, or Firm* — Lee & Morse, P.C.

(57) ABSTRACT

An organic light emitting display device includes a scan driving unit supplying a first scan signal and a second scan signal to each of a plurality of scan lines; a data driving unit supplying data signals to each of a plurality of data lines to be synchronized with the second scan signal; pixels positioned at intersections of the scan lines with the data lines, receiving bias power when the first scan signal is supplied, and receiving the data signals when the second scan signal is supplied.

17 Claims, 7 Drawing Sheets

ORGANIC LIGHT EMITTING DISPLAY DEVICE AND DRIVING METHOD THEREOF

CROSS-REFERENCE TO RELATED APPLICATION

This application claims priority under 35 U.S.C. §119 to and the benefit of Korean Patent Application No. 10-2012-0112135, filed on Oct. 10, 2012, in the Korean Intellectual Property Office, the entire content of which is incorporated herein by reference.

BACKGROUND

1. Field of the Invention

Embodiments relate to an organic light emitting display device and a driving method thereof.

2. Description of the Related Art

Recently, various flat panel display devices capable of reducing weight and volume, which are disadvantages of a cathode ray tube, have been developed. These flat panel display device include a liquid crystal display (LCD), a field emission display (FED), a plasma display panel (PDP), an organic light emitting display (OLED), and the like.

Among them, the organic light emitting display device, which displays an image using an organic light emitting diode generating light by recombination between electrons and holes, has advantages of rapid response speed and low power consumption.

The organic light emitting display device includes a plurality of data lines, a plurality of scan lines, and a plurality of pixels arranged in the form of a matrix at intersections of the power lines. The pixels generally each include an organic light emitting diode and a driving transistor controlling an amount of current flowing to the organic light emitting diode. The above-mentioned pixel supplies current from the driving transistors to the organic light emitting diode corresponding to a data signal to generate light having a predetermined luminance.

However, in the pixel in the related art, in the case of representing a white grayscale after having implemented a black grayscale as shown in FIG. 1, a generated light may have luminance lower than desired luminance during periods of about two frames. In this case, in each pixel, the image is not represented in the desired luminance corresponding to the grayscale, which, in turn, luminance uniformity deteriorates, thereby causing image quality of moving pictures to deteriorate.

According to an experimental result, deterioration of a response characteristic is caused by a characteristic of a driving transistor included in the pixel. In other words, a threshold voltage of the driving transistor is shifted corresponding to voltage applied to the driving transistor during the previous period of frame, and, due to the shifted threshold voltage, light having the desired luminance is not generated in a current frame.

SUMMARY OF THE INVENTION

One or more embodiments provide an organic light emitting display device including a scan driving unit supplying a first scan signal and a second scan signal to each of scan lines, a data driving unit supplying data signals to the data lines so as to be synchronized with the second scan signal, pixels positioned at intersections of the scan lines with the data lines, receiving bias power when the first scan signal is supplied, and receiving the data signals when the second scan signal is supplied.

The data driving unit may further supply the bias power so as to be synchronized with the first scan signal. The second scan signal may be set to have a width wider than that of the first scan signal. The second scan signal supplied to a j−1-th (j is a natural number) scan line may be positioned between the first scan signal and the second scan signal supplied to a j-th scan line.

Each of the pixels positioned in a i-th (i is a natural number) horizontal line may include: an organic light emitting diode; a first transistor controlling an amount of current supplied from a first power supply connect to a second node to the organic light emitting diode corresponding to voltage applied to a first node; a second transistor connected between the first node and an initiation power supply and having a gate electrode connected to an i−1-th scan line; a third transistor connected between the first node and a second electrode of the first transistor, and having a gate electrode connected to an i-th scan line; a fourth transistor connected between the data line and the second node and having a gate electrode connected to the i-th scan line; and a storage capacitor connected between the first node and the first power supply.

When the initiation power is applied to the first node and the bias power is applied to the second node, voltage of the bias power may be set so that an on-bias voltage is applied to the first transistor. The scan driving unit may further supply the light emitting signals to the light emitting control lines formed in parallel with the scan lines. The light emitting control signal supplied to a j-th (j is a natural number) may overlap with the first and second scan signals supplied to the j−1-th scan line and the j-th scan line.

The pixel may further include: a fifth transistor positioned between the first power supply and the second node, and turned off when the light control signal is supplied to an i-th light emitting control line; and a sixth transistor connected between the second node of the first transistor and the organic light emitting diode and turned off when the light emitting control signal is supplied to the i-th light emitting control line. The organic light emitting display device may further includes a de-multiplexer connected to each of the output lines of the data driving unit and sequentially supplying a plurality of data signals supplied to the output lines to the plurality of data lines corresponding to the control signals, and a bias voltage supplying unit supplying the bias power to the data lines.

The bias voltage supplying unit may be connected between the bias power supply and each of the data lines and includes a switching element which is turned on when the bias control signal is supplied. The bias control signal is supplied so as to be synchronized with the first scan signal. The control signals may not be overlapped with the first scan signal and the second scan signal.

One or more embodiments provide a driving method of an organic light emitting display device comprising: supplying each of a first scan signal and a second scan signal to scan lines; and supplying bias power to pixels when the first scan signal is supplied and supplying data signals to the pixels when the second scan signal is supplied.

The pixel may include a driving transistor controlling an amount of current supplied to an organic light emitting diode, and an initialization power set to have voltage lower than that of the data signal may be supplied to a gate electrode of the driving transistor when the first scan signal. The bias power may be supplied to a source electrode of the driving transistor, a voltage of the bias power may be set so that an on-bias voltage may be able to be applied to the driving transistor. The second scan signal may be set to have a width wider than that of the first scan signal. The second scan signal supplied to the j−1-th scan line may be positioned between the first scan signal and the second scan signal supplied to the j-th scan line.

DETAILED DESCRIPTION OF THE INVENTION

Korean Patent Application No. 10-2012-0112135, filed on Oct. 10, 2012, in the Korean Intellectual Property Office, and entitled: "Organic Light Emitting Display Device and Driving Method Thereof" is incorporated by reference herein in its entirety.

Hereafter, exemplary embodiments which will allow those skilled in the art to readily practice will be described below in detail with reference to FIG. 2 to FIG. 7.

Figure 1:
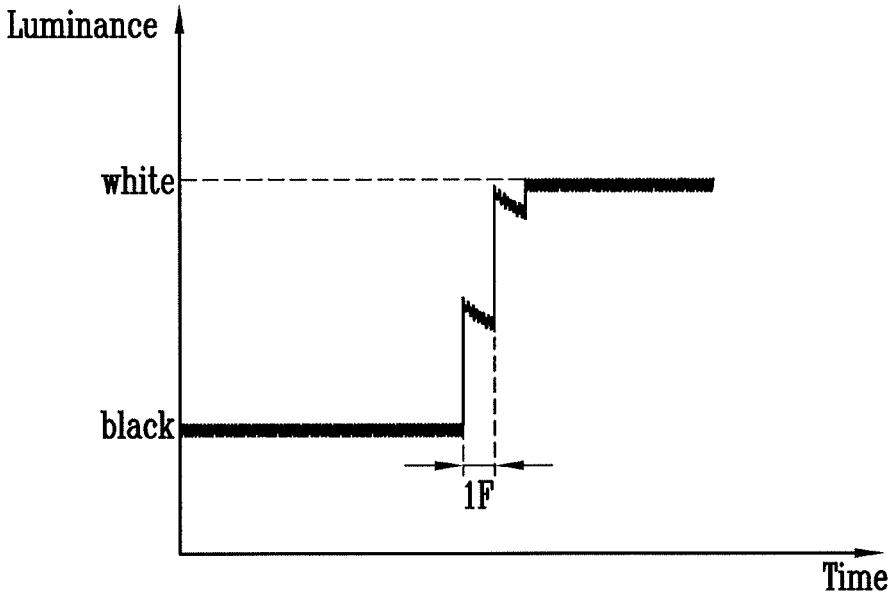
FIG. 1 is a view showing a luminance deviation corresponding to grayscales.
Figure 2:
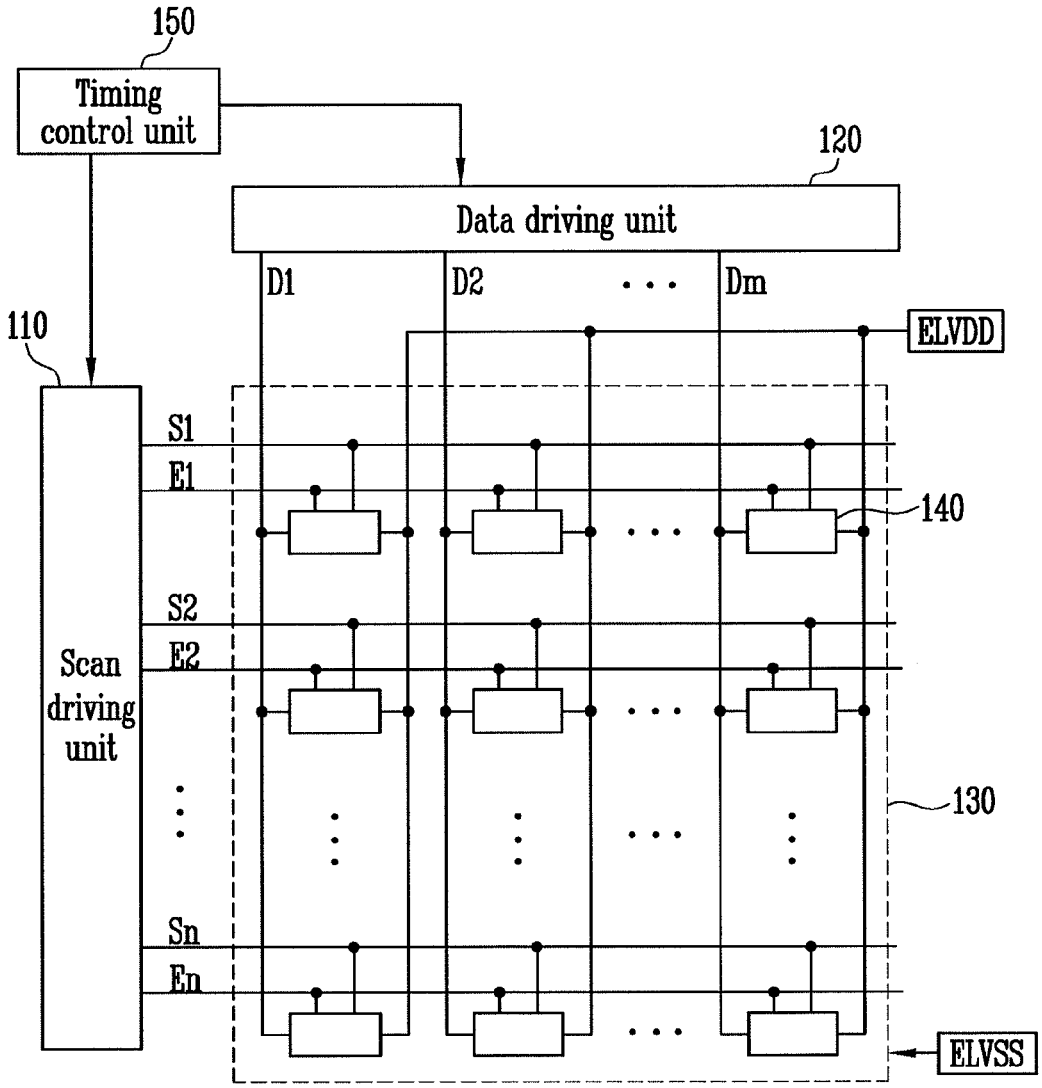
FIG. 2 is a view showing an organic light emitting display device according to an exemplary embodiment.

FIG. 2 is a view showing an organic light emitting display device according to an exemplary embodiment.

Referring to FIG. 2, the organic light emitting display device according to the exemplary embodiment is configured to include a pixel unit 130 including pixels 140 positioned so as to be connected to scan lines S1 to Sn and data lines D1 to Dm, a scan driving unit 110 driving the scan lines S1 to Sn and light emitting control lines E1 to En, a data driving unit 120 driving the data lines D1 to Dm, and a timing control unit 150 controlling the data driving unit 120.

The scan driving unit 110 supplies scan signals to the scan lines S1 to Sn and light emitting control signals to the light emitting control lines E1 to En corresponding to controls of the timing control unit 150.

The scan driving unit 110 supplies a first scan signal SS1 and second scan signal SS2 sequentially to each of the scan lines S1 to Sn. The first scan signal SS1 is used to apply bias voltage to the transistor included in each of the pixels 140, and the second scan signal SS2 is used to supply the data signal to each of the pixels 140. The second scan signal SS2 is set to have a width wider than that of the first scan signal SS1 so as to stably charge each of the pixels 140 with a desired data signal voltage.

In addition, the first scan signal SS1 that is supplied to a j-th scan line Sj (j is a natural number) is supplied between the first scan signal SS1 and the second scan signal SS2 supplied to a j−1-th scan line Sj−1. In relation to this, detailed description will be described below.

Additionally, the scan driving unit 110 supplies the light emitting control signals set to have a width wider than that of the scan signal to the light emitting control lines E1 to En. As an example, the scan driving unit 110 may supply the light emitting control signal to a j-th light emitting control line Ej so as to overlap the first scan signal SS1 and the second scan signal SS2 supplied to the j-th scan line Sj and the j−1-th scan line Sj−1.

The scan signal supplied to the scan driving unit 110 is set to a voltage at which the transistor included in the pixels 140 may be turned on, for example, a low voltage. In addition, the light emitting control signal supplied from the scan driving unit 110 is set to a voltage at which the transistor included in the pixels 140 may be turned off, for example, a high voltage.

The data driving unit 120 supplies the bias voltage Vbias and the data signals DS to the data lines D1 to Dm corresponding to controls of the timing control unit 150. Here, the data driving unit 120 supplies the bias voltage Vbias to the data lines D1 to Dm to be synchronized with the first scan signal SS1 and the data signals DS to the data lines D1 to Dm to be synchronized with the second scan signal SS2.

The timing control unit 150 controls the scan driving unit 110 and the data driving unit 120 corresponding to synchronized signals supplied from the outside.

The pixel unit 130 receives powers of a first power supply ELVDD and a second power supply ELVSS from the outside and supplies the powers to each of pixels 140. The pixels 140 are selected in a horizontal line unit corresponding to the scan signals SS1 and SS2 supplied to the scan lines S1 to Sn an the selected pixel receives the bias voltage Vbias or the data signal DS.

Although each of the pixels 140 is connected to the light emitting control line and the scan line positioned in the same horizontal line in FIG. 2, embodiments are not limited thereto. For example, each of the pixels 140 may be further connected to the scan line and/or the light emitting control line positioned in a previous or next horizontal line corresponding to a structure of pixel circuits.

Figure 3:
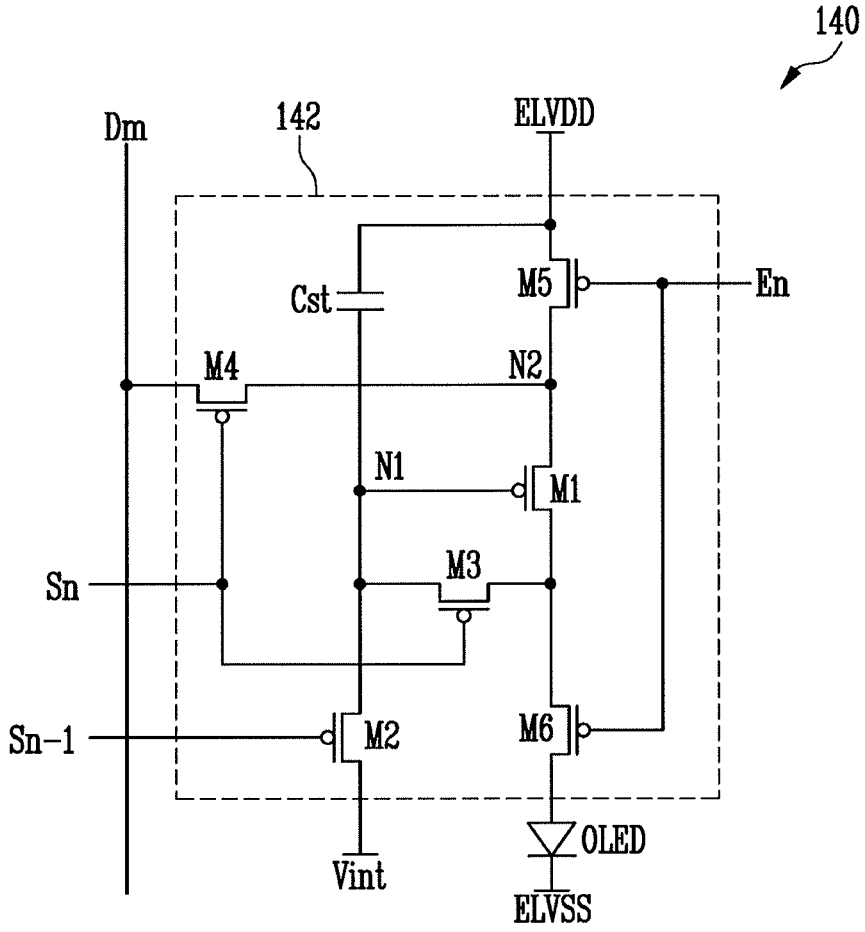
FIG. 3 is a view showing a pixel according to the exemplary embodiment.

FIG. 3 is a view showing a pixel according to an exemplary embodiment. In FIG. 3, for convenience of explanation, the pixel positioned in an n-th horizontal line will be illustrated.

Referring to FIG. 3, the pixel 140 according to the exemplary embodiment includes a pixel circuit 142 connected to the organic light emitting diode (OLED), the data line Dm, the scan lines Sn−1 and Sn, and the light emitting control line En, to control an amount of current supplied to the OLED.

An anode electrode of the OLED is connected to the pixel circuit 142 and a cathode electrode thereof is connected to the second power supply ELVSS. The OLED described above generates light having a predetermined luminance corresponding to the amount of current supplied from the first power supply ELVDD through the pixel circuit 142.

The pixel circuit 142 controls the amount of current supplied to the OLED corresponding to the data signal. To this end, the pixel circuit 142 includes first to sixth transistors M1 to M6 and a storage capacitor Cst.

A first electrode of the first transistor M1 is connected to the second node N2, and a second electrode thereof is connected to a first electrode of the sixth transistor M6. In addition, a gate electrode of the first transistor M1 is connected to a first node N1. The first transistor M1 described above controls the amount of current supplied to the OLED corresponding to voltage applied to the first node N1, that is, voltage charged in the storage capacitor Cst.

The second transistor M2 is connected between the first node N1 and an initialization power supply Vint. In addition, a gate electrode of the second transistor M2 is connected to the n−1-th scan line Sn−1. The second transistor M2 described above is turned on when the scan signals SS1 and SS2 are supplied to the n−1-th scan line Sn−1 to supply voltage of the initialization power supply Vint to the first node N1. Here, the initialization power supply Vint is set to have voltage lower than that of the data signal.

A first electrode of the third transistor M3 is connected to a second electrode of the first transistor M1, and a second electrode thereof is connected to the first Node N1. In addition, a gate electrode of the third transistor M3 is connected to the n-th scan line Sn. When the scan signals SS1 and SS2 are supplied to the n-th scan line Sn the third transistor M3 is turned on to diode-connect the first transistor M1.

A first electrode of the fourth transistor M4 is connected to the data line Dm and a second electrode thereof is connected to the second node N2. In addition, a gate electrode of the fourth transistor M4 is connected to the n-th scan line Sn. When the scan signals SS1 and SS2 are supplied to the n-th scan line Sn the fourth transistor M4 is turned on to electrically connect the data line Dm to the second node N2.

A first electrode of the fifth transistor M5 is connected to the first power supply ELVDD and a second electrode thereof is connected to the second N2. In addition, a gate electrode of the fifth transistor M5 is connected to the n-th light emitting control line En. The fifth transistor M5 is turned off when the light emitting control signal is supplied to the n-th light emitting control line En and is turned on when the light emitting control signal is not supplied thereto.

A first electrode of the sixth transistor M6 is connected to a second electrode of the first transistor M1, and a second electrode thereof is connected to an anode electrode of the OLED. In addition, a gate electrode of the seventh transistor M6 is connected to the n-th light emitting control line En. The sixth transistor M6 is turned off when the light emitting control signal is supplied to the n-th light emitting control line En and is turned on when the light emitting control signal is not supplied thereto.

The storage capacitor Cst is connected between the first node N1 and the first power supply ELVDD. The storage capacitor Cst described above is charged with voltage corresponding to the voltage of the data signal and the threshold voltage of the first transistor M1

Figure 4:
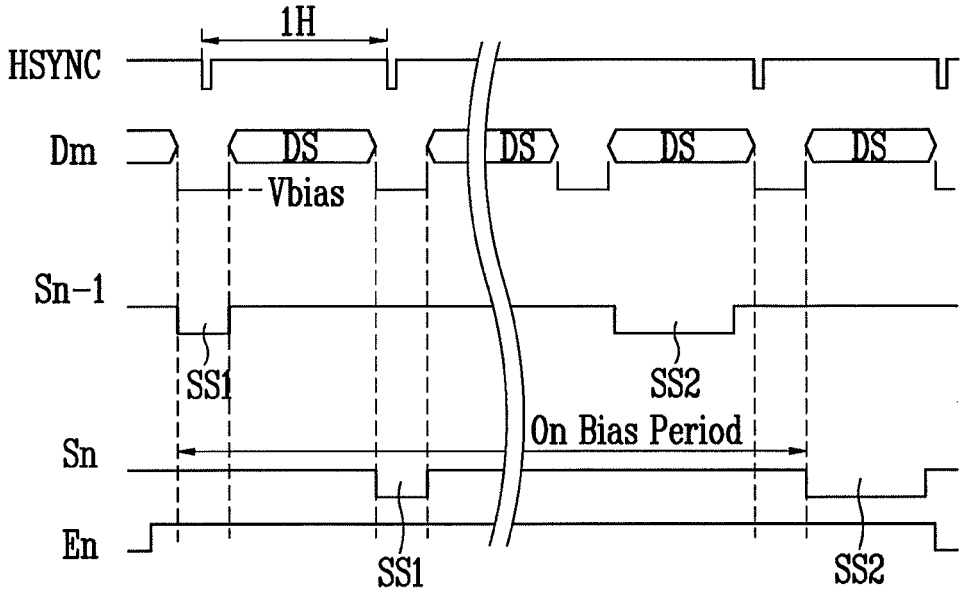
FIG. 4 is a waveform diagram showing an example of a method of driving the pixel shown in FIG. 3.

FIG. 4 is a waveform diagram showing an example of a method of driving the pixel shown in FIG. 3.

Referring to FIG. 4, first, the light emitting control signal is supplied to the light emitting control line En to turn on the fifth transistor M5 and the sixth transistor M6. When the fifth transistor M5 is turned off, the first power supply ELVDD and the second node N2 are electrically blocked from each other. When the sixth transistor M6 is turned off, the first transistor M1 and the OLED are electrically blocked from each other. That is, during a period of time supplying the light emitting control signal, the pixel 140 is set to a non-light-emitting state.

Thereafter, the first scan signal SS1 is supplied to an n−1-th scan line Sn−1. When the first scan signal SS1 is supplied to the n−1-th scan line Sn−1, the second transistor M2 is turned on. When the second transistor M2 is turned on, a voltage of the initialization power supply Vint is supplied to the first node N1. In this case, the first node N1 is set to have the voltage of the initialization power supply Vint, which is lower than that of the data signal. Meanwhile, when the first scan signal SS1 is supplied to the n−1-th scan line Sn−1, the second node N2 is set to a floating state. Here, the second node N2 approximately maintains the voltage of the first power supply ELVDD by a parasitic capacitor, which is not shown, or the like. Therefore, when the first scan signal SS1 is supplied to the n−1-th scan line Sn−1, an on-bias voltage is applied to the first transistor M1. That is, during the period of time supplying the first scan signal SS1 to the n−1-th scan line Sn−1, the first transistor M1 is initialized to an on-bias state.

Thereafter, the first scan signal SS1 is supplied to the n-th scan line Sn to turn on the third and fourth transistors M3 and M4. When the third transistor M3 is turned on, the first transistor M1 is diode-connected. When the fourth transistor M4 is turned on, the bias voltage Vbias from the data line Dm is supplied to the second node N2. Here, the bias voltage Vbias is associated with the voltage of the initial power supply Vint applied to the first node N1, and thus is set so that the on-bias voltage may be applied to the first transistor M1. As an example, the bias voltage Vbias may be set to have voltage higher than that of the initial power supply Vint. Therefore, during the period of time supplying the first scan signal SS1 to the n-th scan line Sn, the first transistor M1 is initialized to the on-bias state.

Thereafter, the second scan signal SS2 is supplied to the n−1-th scan line Sn−1. The second transistor M2 is turned on by the second scan signal SS2 in the n−1-th scan line Sn−1, such that the voltage of the initialization voltage Vint is supplied to the first node N1. In this case, the on-bias voltage is applied to the first transistor M1 by the bias voltage Vbias applied to the second node N2 by the parasitic capacitor, which is not shown, or the like, and the voltage of the initialization voltage Vint applied to the first node N1.

The on-bias voltage is applied to the n-th scan line Sn and then the second scan signal SS2 is supplied to the n-th scan line Sn to turn on the third and fourth transistors M3 and M4. When the third transistor M3 is turned on, the first transistor M1 is diode-connected. When the fourth transistor M4 is turned on, the data signal DS supplied from the data line Dm is supplied to the second node N2.

Here, since the first node N1 has been set to have voltage lower than that of initialization power supply Vint, the first transistor M1 is turned on. When the first transistor M1 is turned on, the voltage obtained by subtracting the threshold voltage of the first transistor M1 from that of the data signal is supplied to the first node N1. The storage capacitor Cst is charged with the predetermined voltage corresponding to the voltage applied to the first node N1.

After a predetermined voltage is charged in the storage capacitor Cst, the supply of the light emitting controlling signal to the light emitting controlling line En is interrupted, such that the fifth and sixth transistors M5 and M6 are turned on. When the fifth and sixth transistors M5 and M6 are turned on, a current path is formed from the first power supply ELVDD to the second power supply ELVSS via the OLED. Here, the first transistor M1 controls the amount of current supplied to the OLED corresponding to the voltage charged in the storage capacitor Cst.

As described above, according to the exemplary embodiment, during a predetermined period from a point when the first scan signal SS1 is supplied to the n−1 scan line Sn−1 to a point when the data signal DS is supplied to the pixel 140, the first transistor M1 is set to the on-bias state. Therefore, the characteristic of the first transistor M1 of the first transistor M1 is set to a specific state, thereby making it possible to represent the uniform image in the pixel unit 130 regardless of the image displayed in the previous frame period.

While the data driving unit 120 is shown to be directly connected to the pixels in FIG. 2, embodiments are not limited thereto. For example, the data driving unit 120 may be connected to the pixels 140 via a de-multiplexer.

Figure 5:
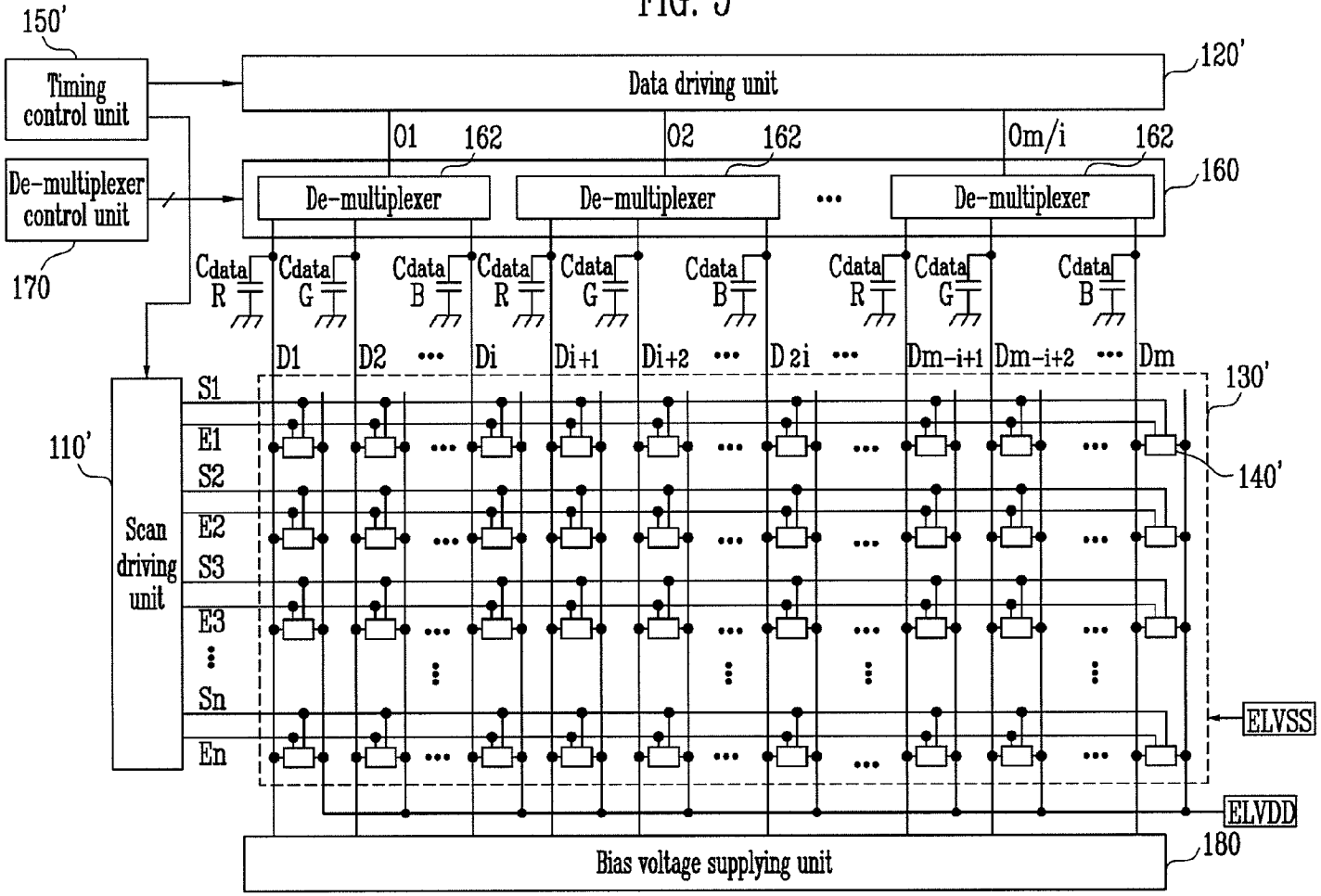
FIG. 5 is a view showing an organic light emitting display device according to another exemplary embodiment.

FIG. 5 is a view showing an organic light emitting display device according to another exemplary embodiment of the present invention. In FIG. 5, a detailed description of the same components as those of FIG. 2 will be omitted.

Referring to FIG. 5, an organic light emitting display device (OLED) according to another exemplary embodiment is configured to include a scan driving unit 110', a data driving unit 120', a pixel unit 130', a timing control unit 150', a de-multiplexer block unit 160, a de-multiplexer control unit 170, a bias voltage supplying unit 180, and data capacitors Cdata.

Figure 7:
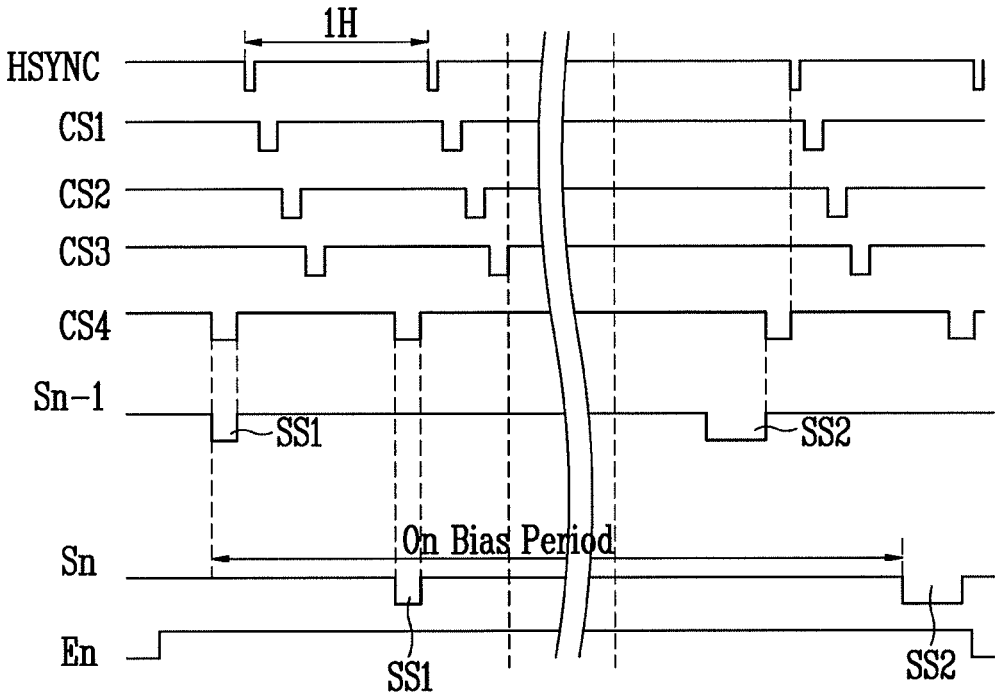
FIG. 7 is a waveform diagram showing an example of a method of driving a pixel shown in FIG. 6.

The pixel unit 130 receives power of a first power supply ELVDD and a second power supply ELVSS from the outside and supplies the powers to each of each of pixels 140. The pixels 140' are selected in a horizontal line unit corresponding to the scan signals SS1 and SS2 supplied to the scan lines S1 to Sn and the selected pixel receives the bias voltage Vbias or the data signal DS, as shown in FIG. 7. Here, the pixels 140' may have various structures, for example, the structure in FIG. 3, and a detailed description thereof will be omitted.

The scan driving unit 110' supplies scan signals to the scan lines S1 to Sn and light emitting control signals to the light emitting control lines E1 to En in accordance with control signals of the timing control unit 150'.

Here, the scan driving unit 110' sequentially supplies the first scan signal SS1 and the second scan signal SS2 to each of the scan lines S1 to Sn. Here, the first scan signal SS1 is used to supply bias voltage to the pixels 140', and the second scan signal SS2 is used to supply the data signal to the pixels 140'. To this end, the first scan signal SS1 is supplied to overlap with a fourth control signal CS4 (or bias control signal) used to supply the bias voltage Vbias to the data lines D1 to Dm. In addition, the first scan signal SS1 and the second scan signal SS2 do not overlap with the a first control signal CS1 and a third control signal CS3 used to supply the data signal DS to the data lines D1 to Dm.

The data driving unit 120' sequentially supplies a plurality of data signals to each of output lines O1 to Om/i corresponding to controls of the timing control unit 150'. As an example, the driving unit 120' may sequentially supply three data signals to each of the output lines O1 to Om/i so as to overlap with each of the first to third control signals CS1 to CS3.

The timing control unit 150' controls the scan driving unit 110' and the data driving unit 120' in accordance with synchronized signals supplied from the outside.

The de-multiplexer block unit 160 includes m/I de-multiplexers 162. In other words, the de-multiplexer block unit 160 includes the same number of de-multiplexers as that of the output lines O1 to Om/i, and each de-multiplexer is connected to respective ones of the output lines O1 to Om/i. In addition, each de-multiplexer 162 is connected to i data lines D. The de-multiplexer 162 described above supplies i data signals supplied to the output line O during a data period to the data lines D.

As described above, when the data signals supplied to one output line O is supplied to i data lines D, the number of output lines included in the data driving unit 120 significantly decreases. For example, assuming i is three, the number of output lines O included in the data driving unit 120 is reduced to about ⅓ of that of the related art, and as a consequence, the number of driving circuits included in the data driving unit 120 is reduced. That is, according to another embodiment, data signals supplied to an output line O is supplied to the i data lines using the de-multiplexer 162, thereby making it possible to reduce manufacturing cost.

The de-multiplexer control unit 170 supplies i control signals to each of de-multiplexers 162 during the data period in one horizontal period so that the i data signals supplied to the output line O may be dividedly supplied to the i data lines. As an example, the de-multiplexer control unit 170 supplies the first to third control signals CS1 to CS3 sequentially in order not to overlap with one another.

The bias voltage supplying unit 180 supplies the bias voltage Vbias to the data lines D1 to Dm corresponding to the fourth control signal CS4.

Data capacitors Cdata is installed in each of data lines D. The data capacitors Cdata temporarily stores data signals supplied to the data lines D and supplies the stored data signals to the pixels 140. Here, each of the data capacitors Cdata is used as a parasitic capacitor, which is equivalently formed in the data lines D. In practice, each parasitic capacitor equivalently formed in data lines D have a capacity larger than that of the storage capacitor formed in each pixel 140'. Therefore, the parasitic capacitor may stably store the data signals.

Figure 6:
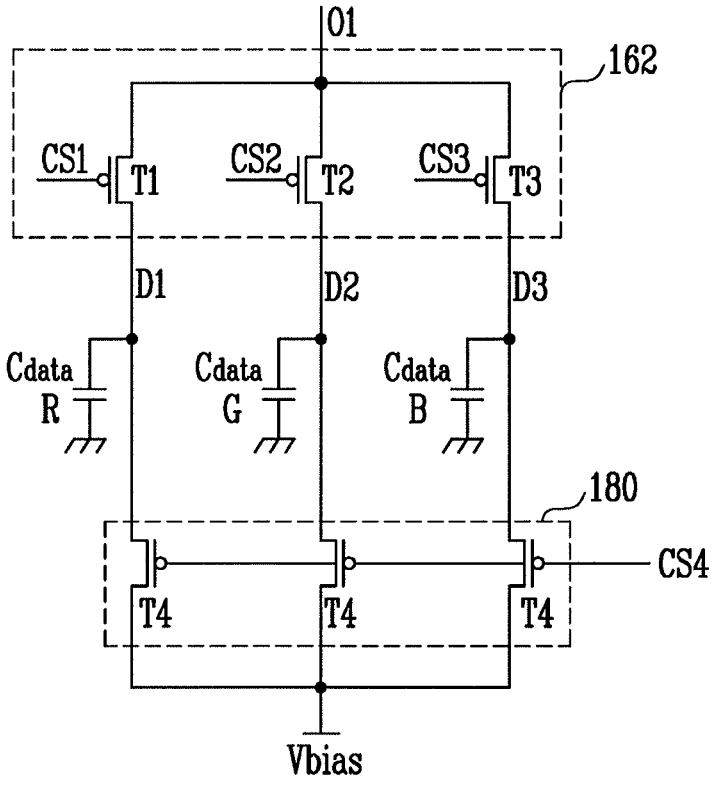
FIG. 6 is a view showing a de-multiplexer and a bias voltage supplier shown in FIG. 5.

FIG. 6 is a view showing a de-multiplexer and a bias voltage supplier shown in FIG. 5. In FIG. 6, for convenience of explanation, it is assumed that each de-multiplexer is connected to three data lines. Referring to FIG. 6, each de-multiplexer 162 includes three switching elements T1 to T3.

A first switching element T1 is connected between the first output line O1 and the first data line D1. When the first control signal CS1 is supplied from the de-multiplexer control unit 170, the above-mentioned first switching element T1 is turned on to supply to the first data line D1 the data signal supplied to the first output line O1. When the first control signal CS1 is supplied, the data signal supplied to the first data line D1 is temporarily stored in the capacitor CdataR.

A second switching element T2 is connected between the first output line O1 and the second data line D2. When the second control signal CS2 is supplied from the de-multiplexer control unit 170, the above-mentioned second switching element T2 is turned on to supply to the second data line D2 the data signal supplied to the first output line O1 When the second control signal CS2 is supplied, the data signal supplied to the second data line D2 is temporarily stored in the capacitor CdataG.

A third switching element T3 is connected between the first output line O1 and the third data line D3. When the third control signal CS3 is supplied from the de-multiplexer control unit 170, the above-mentioned third switching element T3 is turned on to supply to the third data line D3 the data signal supplied to the first output line O1. When the third control signal CS3 is supplied, the data signal supplied to the third data line D3 is temporarily stored in the capacitor CdataB.

The bias voltage supplying unit 180 includes a fourth switching element T4 connected between each of the data lines D1 to D3 and a bias power supply Vbias. When the fourth control signal CS4 is supplied, the above-mentioned switching element T4 supplies voltage of the bias power supply Vbias to the data lines D1 to D3. Here, since the fourth control signal CS4 is supplied to be synchronized with the second scan signal SS1, the voltage of the bias power supply Vbias supplied to the data lines D1 to D3 is supplied to pixels. In addition, the fourth control signal CS4 according to the present invention may be supplied from the de-multiplexer control unit 170 or the timing control unit 150'.

FIG. 7 is a waveform diagram showing an example of a method of driving a pixel shown in FIG. 6.

Referring to FIGS. 3 and 7, first, the light emitting control signal is supplied to the light emitting control line En to turn on the fifth transistor M5 and the sixth transistor M6. When the fifth transistor M5 is turned off, the first power supply ELVDD and the second node N2 are electrically blocked from each other. When the sixth transistor M6 is turned off, the first transistor M1 and the OLED are electrically blocked from each other. That is, when the light emitting control signal is supplied, the pixel 140 is set to a non-light-emitting state.

Thereafter, the first scan signal SS1 is supplied to an n−1-th scan line Sn−1. When the first scan signal SS1 is supplied to the n−1-th scan line Sn−1, the second transistor M2 is turned on. When the second transistor M2 is turned on, voltage of the initialization power supply Vint is supplied to the first node N1. In this case, the first node N1 is set to have the voltage of the initialization power supply Vint, which is lower than that of the data signal. Meanwhile, when the first scan signal SS1 is supplied to the n−1-th scan line Sn−1, the second node N2 is set to a floating state. Here, the second node N2 approximately maintains the voltage of the first power supply ELVDD by a parasitic capacitor, which is not shown, or the like. Therefore, when the first scan signal SS1 is supplied to the n−1-th scan line Sn−1, an on-bias voltage is applied to the first transistor M1. That is, during the period of time supplying the first scan signal SS1 to the n−1-th scan line Sn−1, the first transistor M1 is initialized to an on-bias state.

Thereafter, the first scan signal SS1 is supplied to the n-th scan line Sn to turn on the third and fourth transistors M3 and M4. When the third transistor M3 is turned on, the first transistor M1 is diode-connected. When the fourth transistor M4 is turned on, the bias voltage Vbias from the data line Dm is supplied to the second node N2. Here, the bias voltage Vbias is associated with the voltage of the initial power supply Vint applied to the first node N1, and thus is set so that the on-bias voltage may be applied to the first transistor M1. As an example, the bias voltage Vbias may be set to have voltage higher than that of the initial power supply Vint. Therefore, during the period of time supplying the first scan signal SS1 to the n-th scan line Sn, the first transistor M1 is initialized to the on-bias state.

Thereafter, the second scan signal SS2 is supplied to the n−1-th scan line Sn−1. When the second scan signal SS2 is supplied to the n−1-th scan line Sn−1, the second transistor M2 is turned on, such that the voltage of the initialization voltage Vint is supplied to the first node N1. In this case, the on-bias voltage is applied to the first transistor M1 by the bias power Vbias applied to the second node N2 by the parasitic capacitor, which is not shown, or the like, and the voltage of the initialization voltage Vint applied to the first node N1.

Thereafter, a voltage corresponding to the data signal is charged by sequentially supplying first and third control signals CS1 to CS3 in the data capacitor Cdata connected each of data lines D1 to Dm.

A voltage corresponding to the data signal DS is applied to the data capacitor Cdata and then the second scan signal SS2 is supplied to the n-th scan line Sn to turn on the third and fourth transistors M3 and M4. When the third transistor M3 is turned on, the first transistor M1 is diode-connected. When the fourth transistor M4 is turned on, the data signal charged in the data capacitor Cdata is supplied to the second node N2.

Here, since the first node N1 has been set to have voltage lower than that of initialization power supply Vint, the first transistor M1 is turned on. When the first transistor M1 is turned on, the voltage obtained by subtracting the threshold voltage of the first transistor M1 from that of the data signal is supplied to the first node N1. The storage capacitor Cst is charged with the predetermined voltage corresponding to the voltage applied to the first node N1.

After a predetermined voltage is charged in the storage capacitor Cst, the supply of the light emitting controlling signal to the light emitting controlling line En is interrupted, such that the fifth and sixth transistors M5 and M6 are turned on. When the fifth and sixth transistors M5 and M6 are turned on, a current path is formed from the first power supply ELVDD to the second power supply ELVSS via the OLED. Here, the first transistor M1 controls the amount of current supplied to the OLED corresponding to the voltage charged in the storage capacitor Cst.

As set forth above, according to embodiments of the organic light emitting device and the driving method, before supplying the data signal, the on-bias voltage is applied to the driving transistor included in each pixel to initialize the characteristic of the threshold voltage. In this case, the image having the uniform luminance may be represented regardless of the voltage applied to the gate electrode of the driving transistor in the previous frame.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a scan driving unit supplying a first scan signal and a second scan signal to each of a plurality of scan lines;

a data driving unit supplying data signals to a plurality of data lines so as to be synchronized with the second scan signal; and a plurality of pixels positioned at intersections of the scan lines with the data lines, the pixels receiving a bias power when the first scan signal is supplied and receiving the data signals when the second scan signal is supplied, each of the pixels including:

an organic light emitting diode;

a first transistor connected to a first node and a second node, the first transistor controlling an amount of current supplied from a first power supply to the organic light emitting diode in accordance with a voltage difference between the first node and the second node; and a second transistor connected between the first node and an initiation power supply, wherein when an initiation power from the initiation power supply is applied to the first node and the bias power is applied to the second node, a voltage of the bias power is set so that an on-bias voltage is applied to the first transistor.

2. The organic light emitting display device of claim 1, wherein the data driving unit further supplies the bias power to be synchronized with the first scan signal.

3. The organic light emitting display device of claim 1, wherein the second scan signal is set to have a width wider than that of the first scan signal.

4. The organic light emitting display device of claim 1, wherein the second scan signal supplied to a j−1-th (j is a natural number) scan line is positioned between the first scan signal and the second scan signal supplied to a j-th-scan line.

5. The organic light emitting display device of claim 1, wherein each of i-th pixels positioned in a i-th (i is a natural number) horizontal line includes:

the second transistor having a gate electrode connected to an i−1-th scan line;

a third transistor connected between the first node and a second electrode of the first transistor, and having a gate electrode connected to an i-th scan line;

a fourth transistor connected between the data line and the second node, and having a gate electrode connected to the i-th scan line; and a storage capacitor connected between the first node and the first power supply.

6. The organic light emitting display device of claim 5, wherein the scan driving unit further supplies light emitting signals to light emitting control lines formed in parallel with the scan lines.

7. The organic light emitting display device of claim 6, wherein a light emitting control signal supplied to an i-th light emitting control line overlaps the first and second scan signals supplied to the i−1-th scan line and the i-th scan line.

8. The organic light emitting display device of claim 6, wherein each of the i-th pixels further includes:

a fifth transistor positioned between the first power supply and the second node, and turned off when a light emitting control signal is supplied to an i-th light emitting control line; and a sixth transistor connected between the second node of the first transistor and the organic light emitting diode, and turned off when the light emitting control signal is supplied to the i-th light emitting control line.

9. The organic light emitting display device of claim 1, further comprising:

a de-multiplexer connected to output lines of the data driving unit and sequentially supplying a plurality of data signals supplied to the output lines to the plurality of data lines corresponding to control signals, and a bias voltage supplying unit supplying the bias power to the data lines.

10. The organic light emitting display device of claim 9, wherein the control signals do not overlap the first CFA scan signal and the second scan control signal.

11. The organic light emitting display device of claim 9, wherein the bias voltage supplying unit is connected between the bias power supply and the data lines and includes switching elements which are turned on when bias control signals are supplied.

12. The organic light emitting display device of claim 11, wherein the bias control signals are supplied to be synchronized with the first scan signal.

13. A driving method of an organic light emitting display device having a plurality of pixels at an intersection of a plurality of scan lines and a plurality of data lines, each of the pixels including:

an organic light emitting diode;

a first transistor connected to a first node and a second node, the first transistor controlling an amount of current supplied from a first power supply to the organic light emitting diode in accordance with a voltage difference between the first node and the second node; and a second transistor connected between the first node and an initiation power supply, the method comprising:

supplying a first scan signal and a second scan signal to each of the scan lines;

supplying a bias power to the pixels when the first scan signal is supplied and supplying data signals to the pixels when the second scan signal is supplied;

supplying an initiation power from the initiation power supply to the first node; and setting a voltage of the bias power such that an on-bias voltage is applied to the first transistor when the initiation power is applied to the first node and the bias power is applied to the second node.

14. The driving method of the organic light emitting of claim 13, wherein supplying the initiation power to the first node includes supplying the initialization power having a voltage lower than that of the data signals to a gate electrode of the first transistor when the first scan signal supplied to an i−1-th scan line (i is a natural number) is supplied.

15. The driving method of the organic light emitting of claim 14, wherein, supplying the bias power to the pixels includes supplying the bias power to a source electrode of the first transistor.

16. The driving method of the organic light emitting of claim 13, wherein the second scan signal is set to have a width wider than that of the first scan signal.

17. The driving method of the organic light emitting of claim 13, wherein the second scan signal supplied to an i−1-th scan line (i is a natural number) is positioned between the first scan signal and the second scan signal supplied to an i-th scan line.

* * * * *